US005722381A

United States Patent [19]

Mizek

[11] Patent Number: 5,722,381

[45] Date of Patent: Mar. 3, 1998

[54] APPARATUS FOR ADJUSTABLY MOUNTING A PIVOTAL ARROW REST

[75] Inventor: Robert S. Mizek, Downers Grove, Ill.

[73] Assignee: New Archery Products Corp., Forest Park, Ill.

[21] Appl. No.: 807,148

[22] Filed: Feb. 27, 1997

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 4,686,956 | 8/1987 | Troncoso | 124/44.5 |
| 4,809,670 | 3/1989 | Simo | 124/44.5 |
| 4,827,895 | 5/1989 | Troncoso, Jr. | 124/44.5 |
| 5,070,855 | 12/1991 | Troncoso | 124/44.5 |
| 5,117,803 | 6/1992 | Johnson | 124/44.5 |
| 5,144,937 | 9/1992 | Colvin | 124/44.5 |
| 5,251,606 | 10/1993 | Colvin | 124/44.5 |
| 5,285,764 | 2/1994 | Mertens | 124/44.5 |
| 5,359,984 | 11/1994 | Simo | 124/44.5 |
| 5,372,119 | 12/1994 | Kidney | 124/44.5 |
| 5,490,491 | 2/1996 | Troncoso | 124/44.5 |

*Primary Examiner*—John A. Ricci
*Attorney, Agent, or Firm*—Speckman, Pauley & Fejer

[57] ABSTRACT

An apparatus for adjustably mounting an arrow rest wherein a pivot shaft is mounted within a through bore of a sleeve, so that the pivot shaft can pivot or rotate between a normal rest position and a maximum forward position. The sleeve is mounted with respect to a bracket that is fixed with respect to an archery bow riser. Opposing end portions of the pivot shaft extend beyond corresponding end surfaces of the sleeve. One of the end portions of the pivot shaft is housed within an end cap bore. A spring has one end foot attached or mounted with respect to the end cap and an opposing end foot attached or mounted with respect to the one end portion of the pivot shaft housed within the end cap bore. A pair of keeper elements and a wave washer or other spring element are attached to or mounted with respect to the pivot shaft to significantly reduce horizontal movement or longitudinal play of the pivot shaft with respect to the sleeve and thus of the arrow rest within a corresponding shooting window.

23 Claims, 3 Drawing Sheets

APPARATUS FOR ADJUSTABLY MOUNTING A PIVOTAL ARROW REST

BACKGROUND OF THE INVENTION

1. Field of the Invention

This invention relates to a mounting apparatus for mounting an arrow rest to a pivot shaft that rotates against a bias force, wherein a radial position and a longitudinal position of the pivot shaft can be adjustably fixed with respect to an archery bow riser.

2. Description of Prior Art

Many conventional mounting apparatuses provide for three dimensional adjustment of an arrow rest with respect to an archery bow riser. Many conventional mounting apparatuses also allow the arrow rest to rotate or pivot forward, in a direction away from a discharged arrow shaft, and also cause the arrow rest to return to an original set position by applying a return bias force either directly or indirectly to the arrow rest.

Troncoso, U.S. Pat. No. 5,490,491 discloses a conventional arrow rest assembly with adjustable angle and tension capability. A mounting block is adapted to extend rearwardly of an archery bow riser. A barrel is mounted within an opening formed by the mounting block. An outer surface of the barrel has a plurality of evenly spaced striations or grooves that run along a length of the barrel. A click blade extends through a passage within the mounting block and intercepts the striations or grooves, so that when the barrel is rotated within the opening the blade makes audible clicks which can be counted in order to restore, if desired, the barrel to its unrotated position. The '491 patent also teaches a cross-bar locked to a cup which is slidably received over the cross-bar. A coiled spring is positioned around an end of the cross-bar and the coiled spring has one arm which is releasably received within an opening in the barrel and another arm which is releasably received within an opening in the cup. Because the coiled spring is connected to the cup and the barrel, not the cross-bar, and because the cup is locked with respect to the cross-bar, when the arrow support rotates, the cup also rotates. Furthermore, when a lock screw is loosened so that the tension of the coiled spring can be adjusted, it is not possible to test the adjusted tension of the coiled spring by rotating the arrow support against the bias force until the lock screw is tightened to secure the cup with respect to the cross-bar.

Johnson, U.S. Pat. No. 5,117,803 teaches an adjustable arrow rest that rotates against a bias force of a torsional coil spring. A cross-bar is rotatably mounted within an opening of a cylindrical barrel. The cylindrical barrel is mounted within a cylindrical opening within a mounting block. The coiled spring is mounted within the cylindrical opening of the mounting block, around an outer surface of the cylindrical barrel. Thus, the coiled spring is positioned between the mounting block and the cylindrical barrel. One end of the torsional spring attaches to the cylindrical barrel on one side of the mounting block and the other end of the coiled spring attaches to a cup which is fixedly mounted on the opposite side of the mounting block. The cup can be rotated to adjust the bias force of the coiled spring.

Conventional apparatuses for mounting arrow rests have several shortcomings. For example, in many conventional arrow rest mounting apparatuses, the arrow rest cannot be rotated or pivoted to feel the changing bias force resistance while adjusting the coil spring. Thus, it is necessary to adjust the coil spring and then lock the adjustment device in order to feel and determine whether an appropriate adjustment was made. Furthermore, with many conventional arrow rest mounting apparatuses, as the arrow rest rotates or pivots the cross-bar and other visible components rotate or pivot with the arrow rest and thus have a greater tendency to bind with surrounding elements and can cause a visual distraction.

There is an apparent need for an arrow rest mounting apparatus that allows an archer to achieve a feel for a changing return bias force while adjusting the spring bias force. In view of the conventional arrow rest mounting apparatuses, there is also an apparent need for a cross-bar that has very little axial play when in a set position. There is yet a further apparent need for an arrow rest mounting assembly that eliminates the noise and feel associated with metal-upon-metal sliding contact as the arrow rest rotates or pivots with respect to an archery bow riser.

SUMMARY OF THEE INVENTION

It is one object of this invention to provide an arrow rest mounting apparatus that allows the arrow rest to rotate or pivot against a spring bias force while minimizing axial play and eliminating metal upon metal sliding contact between two or more elements.

It is another object of this invention to provide an arrow rest mounting apparatus that allows a user to feel the changing spring bias force by rotating the arrow rest while adjusting the spring bias force.

It is still another object of this invention to provide an arrow rest mounting apparatus that houses a spring element completely on one side of the mounting bracket which is opposite from another side of the mounting bracket that faces the arrow rest.

It is yet another object of this invention to provide an arrow rest mounting apparatus in which only the arrow rest and the connected cross-bar or pivot shaft and spring move as the arrow rest pivots from a set position to a forward position.

The above and other objects of this invention are accomplished with an arrow rest mounting apparatus that has a pivot shaft mounted within a sleeve. Opposing shaft end portions of the pivot shaft extend beyond opposing end surfaces of the sleeve. The sleeve preferably has a cylindrical outer surface rotatably and axially or longitudinally adjustably mounted within a through hole of the mounting bracket.

The arrow rest is releasably attached to one shaft end portion of the pivot shaft. An opposite shaft end portion of the pivot shaft is housed within a cap bore of an end cap. One end foot of the spring is mounted with respect to the end cap. Because the opposite end foot of the spring is mounted with respect to the shaft end portion of the pivot shaft which is housed within the cap bore, the end cap can be rotated with respect to the sleeve and thereby adjust the bias force of the spring, by rotating or pivoting the arrow rest between a set position and a maximum forward position, of the pivot shaft with respect to the sleeve, an archer can feel a difference in the resisting bias force while the spring is adjusted.

One keeper element is preferably attached with respect to each shaft end portion of the pivot shaft. A spring element, such as a wave washer, can be positioned between either keeper element and the sleeve in order to reduce axial play of the pivot shaft with respect to the sleeve.

A thrust bearing can be positioned between the keeper element and the sleeve in order to reduce noise and friction associated with metal-upon-metal sliding contact as the arrow rest pivots between the set position and the maximum forward position.

BRIEF DESCRIPTION OF THE DRAWINGS

The above and other features and objects of this invention will be better understood from the following detailed description taken in view of the drawings wherein.

DESCRIPTION OF PREFERRED EMBODIMENTS

Figure 1:
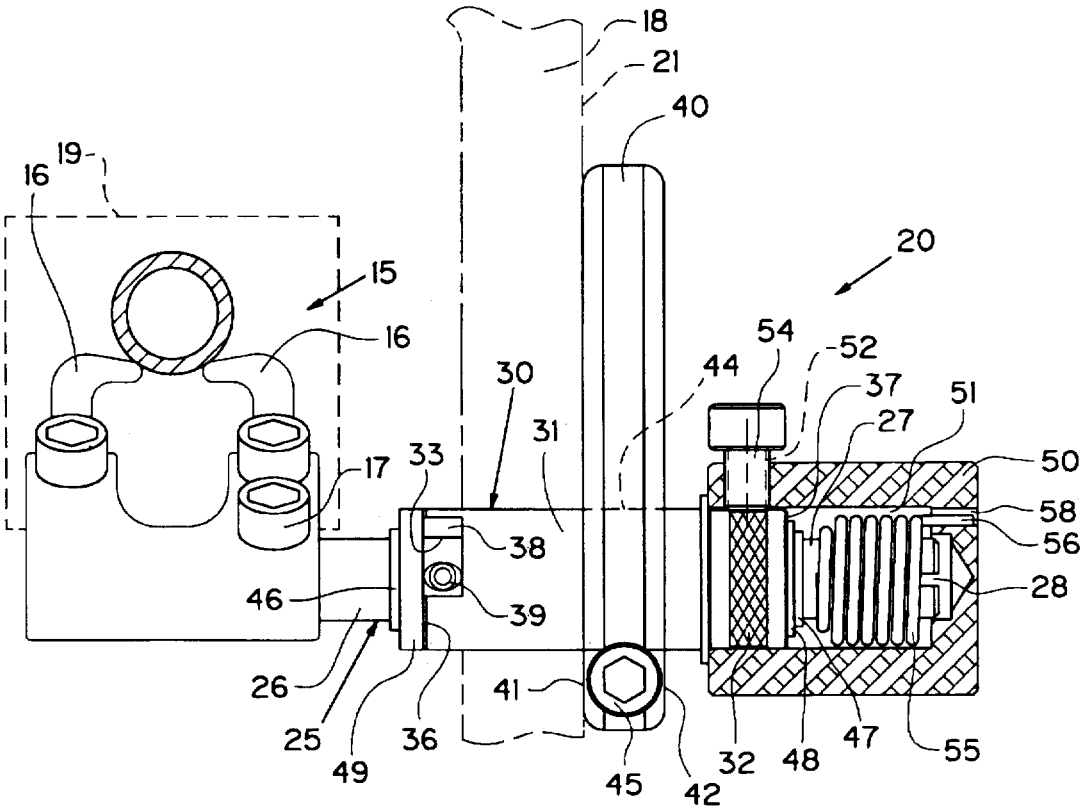
FIG. 1 is a partial cross-sectional front view of an arrow rest mounting apparatus, according to one preferred embodiment of this invention.
Figure 2:
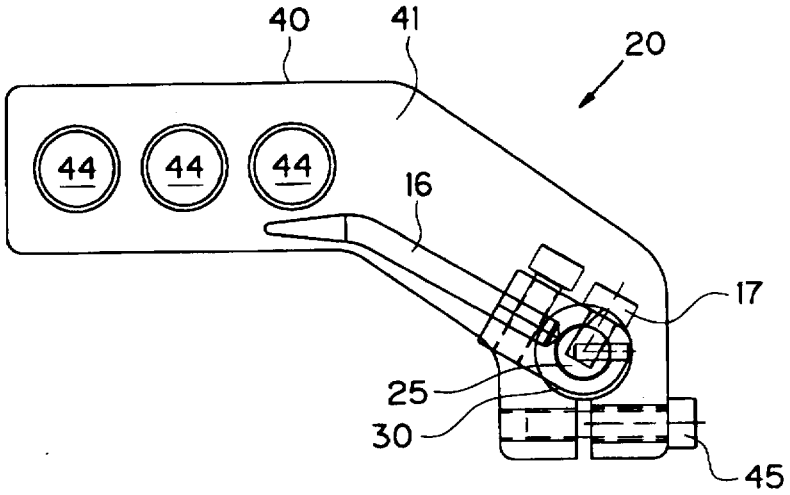
FIG. 2 is a side view, including an overlay of elements, viewed from a shooting window side of an archery bow riser, of the arrow rest mounting apparatus shown in FIG. 1.
Figure 3:
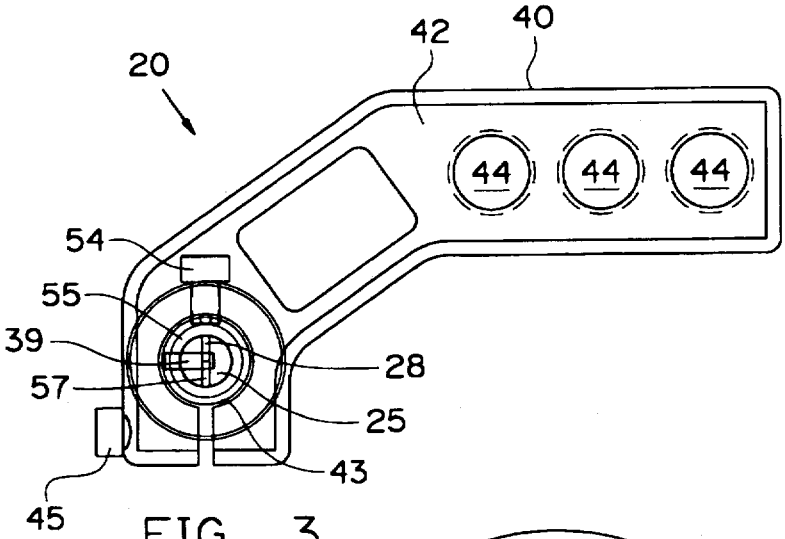
FIG. 3 is a side view, including an overlay of elements, opposite the side view shown in FIG. 2, of the arrow rest mounting apparatus as shown in FIGS. 1 and 2.

Referring to FIG. 1, when in use mounting apparatus 20 is preferably mounted with respect to archery bow riser 18, such as adjacent or abutting mounting surface 21 of archery bow riser 18. As shown in FIGS. 2 and 3, mounting bracket 40 preferably has one or more mounting bores 44, preferably but not necessarily internally threaded, for accommodating standard externally threaded bolts that correspond with standard internally threaded bores within archery bow riser 18, shown in phantom lines. Although the drawings show mounting bracket 40 according to one preferred embodiment Of this invention, it is apparent that archery bow riser 18 can form an integrated or extension bracket similar to mounting bracket 40 and/or a bore similar to mounting bore 44, for accommodating sleeve 30, as later discussed. As shown in FIG. 1, mounting bracket 40 of mounting apparatus 20 is preferably but not necessarily secured to mounting surface 21 of archery bow riser 18 which is opposite shooting window 19, shown in dashed lines. It is apparent that mounting bracket 40 can be conveniently positioned on either side of archery bow riser 18. The front view shown in FIG. 1 represents a view of mounting apparatus 20 that an archer would see when holding archery bow riser 18 in a shooting position. The view shown in FIG. 1 is a typical setup or arrangement for a right-handed archer. It is apparent that a mirror image of mounting apparatus 20 as shown in FIG. 1 would be a typical setup or arrangement for a left-handed archer.

Figure 8:
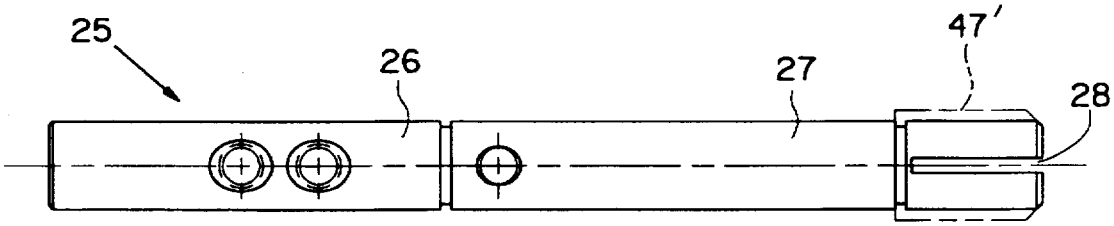
FIG. 8 is a front view of a pivot shaft, similar to the pivot shaft as shown in FIG. 1, according to one preferred embodiment of this invention.
Figure 9:
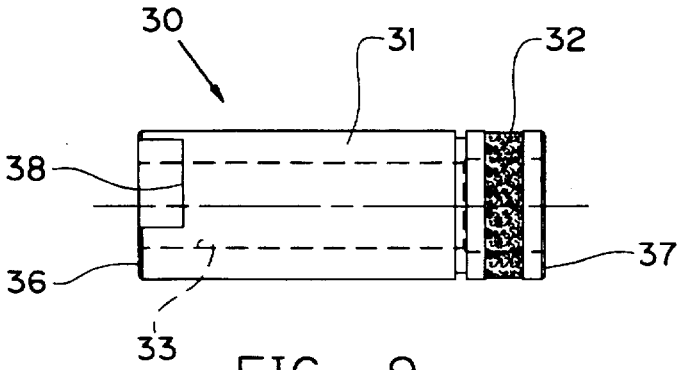
FIG. 9 is a front view of a mounting sleeve, according to one preferred embodiment of this invention.

As shown in FIG. 1, pivot shaft 25 is rotatably mounted within through bore 33 of sleeve 30. Through bore 33, best shown in FIG. 9, is preferably but not necessarily cylindrical. FIG. 8 shows one preferred embodiment of pivot shaft 25, according to this invention. At least a portion of pivot shaft 25 preferably has a generally circular transverse cross section. However, it is apparent that pivot shaft 25 may have any suitable transverse cross section that allows pivot shaft 25 to rotate or pivot within cylindrical through bore 33 of sleeve 30.

Likewise, outer surface 31 of sleeve 30 is preferably but not necessarily cylindrical. It is apparent that outer surface 31 of sleeve 30 can have any suitable peripheral shape that allows sleeve 30 to be rotatably adjustable with respect to mounting bracket 40 and/or archery bow riser 18.

As shown in FIG. 1, end portion 26 of pivot shaft 25 extends beyond side 41, the left side or the shooting window side, of mounting bracket 40. End portion 27 of pivot shaft 25 extends beyond side 42, the right side or the non-shooting window side, of mounting bracket 40. In one preferred embodiment according to this invention, end portion 26 and end portion 27 each extend beyond end surface 36 and end surface 37, respectively, of sleeve 30. With sleeve 30 in a mounted position with respect to mounting bracket 40, as shown in FIG. 1, end surface 36 and end surface 37 are positioned on opposite sides of mounting surface 21 or on opposite sides 41 and 42, respectively, of and at a fixed distance from mounting bracket 40. Arrow rest 15 is releasably attached to or fixed with respect to end portion 26 of pivot shaft 25. In such position, support arms 16 of arrow rest 15 are positioned within shooting window 19.

Mounting means are used to mount and adjustably fix a radial position of sleeve 30 with respect to mounting bracket 40 and/or archery bow riser 18. In one preferred embodiment according to this invention, the mounting means comprise mounting bracket 40 having through hole 43 and a split section, as shown in FIGS. 2 and 3. In another preferred embodiment according to this invention, the mounting means comprise archery bow riser 18 forming an integrated bracket and/or bore that may accommodate sleeve 30. Preferably, the integrated bracket and/or bore would allow sleeve 30 to be mounted to different preferred positions with respect to archery bow riser 18.

Mounting apparatus 20 and/or archery bow riser 18 may further comprise securement means for locking sleeve 30 in a longitudinal position and/or a radial position with respect to mounting bracket 40. As shown in FIGS. 1–3, the securement means comprise adjustment screw 45 operating to open and close the split section of mounting bracket 40. It is apparent that the securement means may also comprise any other suitable locking mechanism or other brackets and mounting devices known to those skilled in the art, such as those incorporated in other conventional arrow rest mounting apparatuses, which can be used to adjust and fix a radial position and/or a longitudinal position of sleeve 30 with respect to archery bow riser 18. As used throughout this specification and in the claims, the phrase axial position is intended to be interchangeable with the phrase longitudinal position.

Although FIGS. 1 and 2 show arrow rest 15 having two support arms 16, any other suitable conventional arrow rest, particularly those that have a shoot-through or shoot-around feature, can be used in lieu of arrow rest 15 as shown in FIGS. 1 and 2. Also, either screw 17, as shown in FIGS. 1 and 2, or any other suitable fastener can be used to releasably attach arrow rest 15 with respect to pivot shaft 25.

Figure 4:
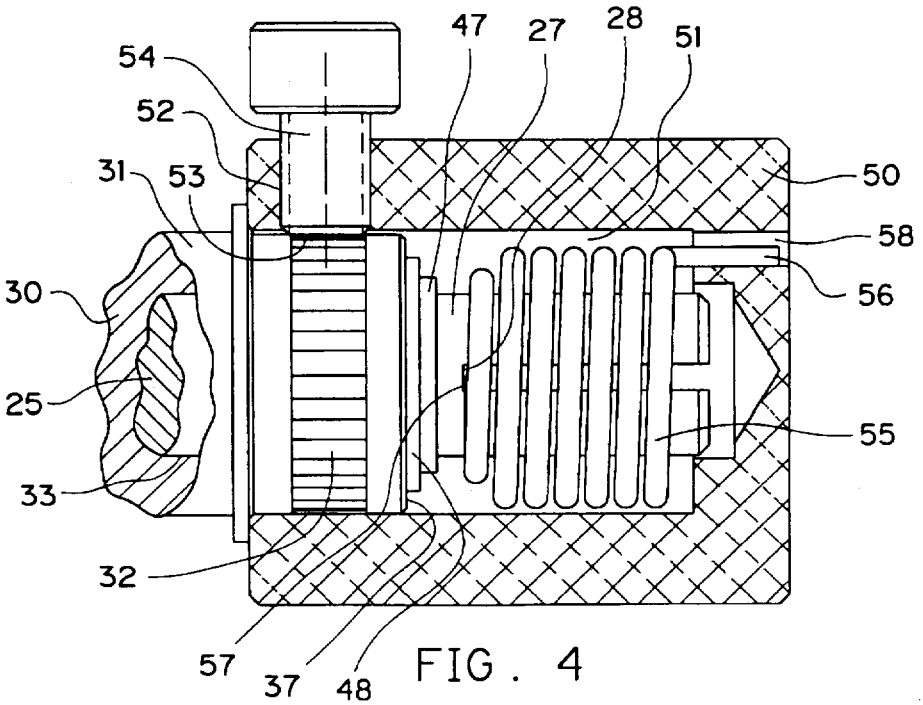
FIG. 4 is an enlarged partial cross-sectional view of an end shaft portion of a pivot shaft and an end cap, according to another preferred embodiment of this invention.

As best shown in FIGS. 1 and 4, end cap 50 comprises cap bore 51 that receives outer surface 31 of sleeve 30. In one preferred embodiment according to this invention, as shown in FIG. 4, outer surface 31 of sleeve 30 is rotatably mounted within cap bore 51 and end portion 27 of pivot shaft 25 is housed within cap bore 51. As shown in FIGS. 1 and 4, according to one preferred embodiment of this invention, end surface 37 of sleeve 30 also is preferably but not necessarily positioned within cap bore 51.

Referring to FIGS. 1 and 4, spring 55 comprises end foot 56 and opposite end foot 57. End foot 56 is attached or mounted with respect to end cap 50. For example, as shown in FIGS. 1 and 4, end foot 56 is positioned or mounted within bore 58 of end cap 50. Thus as end cap 50 rotates with respect to sleeve 30, because of interference with end cap 50, end foot 56 of spring 55 follows the motion of bore 58 and thereby adjusts the bias force of spring 55.

According to one preferred embodiment of this invention, as best shown in FIG. 4, end foot 57 of spring 55 is attached or mounted with respect to end portion 27 of pivot shaft 25. As shown in FIGS. 1, 4 and 8, pivot shaft 25 has opening 28 that accommodates end foot 57. However, it is apparent that any other suitable opening or other mechanical connection, such as a welded connection or another suitable mechanical connection or mounting can be used to attach or mount end foot 57 with respect to end portion 27 of pivot shaft 25.

Having end foot 56 attached or mounted with respect to end cap 50 and end foot 57 attached or mounted with respect to end portion 27 of pivot shaft 25 is an important aspect of one preferred embodiment according to this invention. With such preferred embodiment, end cap 50 can be rotated with respect to sleeve 30 and because end foot 57 is attached or mounted with respect to pivot shaft 25, a user can feel a change in the spring bias force as it is adjusted, such as by pivoting arrow rest 15 between a set position and a maximum forward position, simultaneous with adjusting the bias force of spring 27. In operation, threaded screw 54 can be loosened so that end cap 50 and end foot 57 freely rotate with respect to sleeve 30 and/or pivot shaft 25. Once a desired spring bias force is achieved, threaded screw 54 can be rotated within threaded bore 52 to lock end cap 50 with respect to sleeve 30. According to such preferred embodiment of this invention, it is not necessary to lock end cap 50 with respect to sleeve 30 in order to feel or test the changed tension or bias force of spring 55 acting upon arrow rest 15. This preferred embodiment results in a very quick and efficient adjustment of the bias force acting upon pivot shaft 25 and thus arrow rest 15.

Spring 55 normally urges arrow rest 15 into the set position as shown in FIGS. 1 and 2. As shown in FIGS. 1 and 4, spring 55 is a helical coiled spring. It is apparent that a spiral coiled spring can be used in place of the helical coiled spring shown in FIGS. 1 and 4. With a spiral coiled spring 55, end foot 56 is still attached or mounted with respect to end cap 50 and end foot 57 is still attached or mounted with respect to end portion 27 of pivot shaft 25.

In one preferred embodiment according to this invention, compressible member 53, as shown in FIG. 4, is positioned at least partially within internally threaded bore 52 so that when externally threaded screw 54 is engaged within threaded bore 52 and urged against compressible member 53, compressible member 53 forms frictional contact with and thus resists radial and/or longitudinal movement of end cap 50 with respect to sleeve 30. Compressible member 53 may comprise a disk, a sphere or any other suitably shaped hard rubber, plastic or other relatively deformable material.

Mounting apparatus 20 of this invention may further comprise adjustment means for fixing and/or locking a radial position of end cap 50 with respect to sleeve 30. In one preferred embodiment according to this invention, the adjustment means comprise at least a portion of outer surface 31 of sleeve 30 having an irregular surface, such as a plurality of grooves and/or a roughened surface. The irregular surface can be formed by longitudinal grooves as shown in FIG. 4, radial grooves, cross-hatched grooves as shown in FIG. 1, a fibrous pattern as shown in FIG. 9 molded into or constructed as a part of outer surface 31, or any other irregularly shaped surface that increases frictional and/or interference movement of end cap 50 with respect to sleeve 30.

Many conventional arrow rest mounting apparatuses have a relatively high degree of axial or longitudinal play, so that even when arrow rest 15 is in a set position, arrow rest 15 can move in a horizontal direction, such as the horizontal direction relative to FIG. 1. Even a relatively small degree of horizontal movement or play can have drastic target misalignment results, particularly given the great distance that an arrow flies. In another preferred embodiment according to this invention, such horizontal movement or play can be significantly reduced with keeper 46 attached to end portion 26 of pivot shaft 25 and/or keeper 47 attached to end portion 27 of pivot shaft 25, as shown in FIG. 1. To even further decrease the amount of horizontal movement or the degree of longitudinal play, spring element 48 is positioned between keeper 47 and end surface 37, as best shown in FIG. 4, and/or between keeper 46 and end surface 36, even though not shown in FIGS. 1 and 4.

In one preferred embodiment according to this invention, keeper element 46 or 47 can be formed by pivot shaft 25 having a shoulder portion. For example, pivot shaft 25 may have shoulder 47', shown by the phantom lines in FIG. 8, to act as a keeper in lieu of separate keeper element 47 as shown in FIGS. 1 and 4. It is also apparent that pivot shaft 25 could form a shoulder to replace keeper element 46.

To even further enhance smooth pivoting action of arrow rest 15 with respect to sleeve 30, thrust bearing 49 can be positioned between keeper 46 and end surface 36, as shown in FIG. 1, in order to reduce noise and friction caused by metal-upon-metal contact between elements, such as keeper 46 and end surface 36 of sleeve 30. It is apparent that thrust bearing 49 can be constructed of any resilient non-metal material or can be constructed of any suitable metal material, such as a relatively soft metal.

Figure 5:
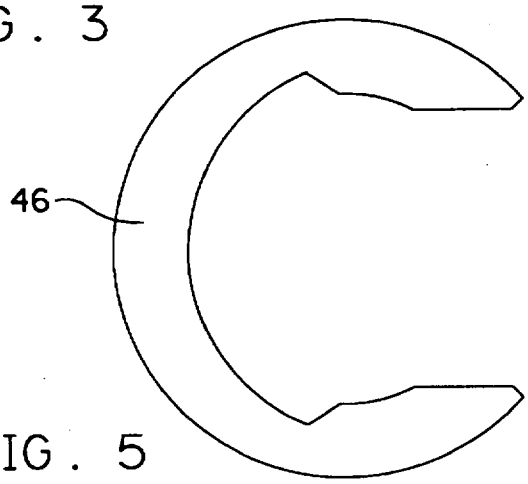
FIG. 5 is a side view of a keeper element, such as either of the keeper elements as shown in FIG. 1, according to one preferred embodiment of this invention.
Figure 6:
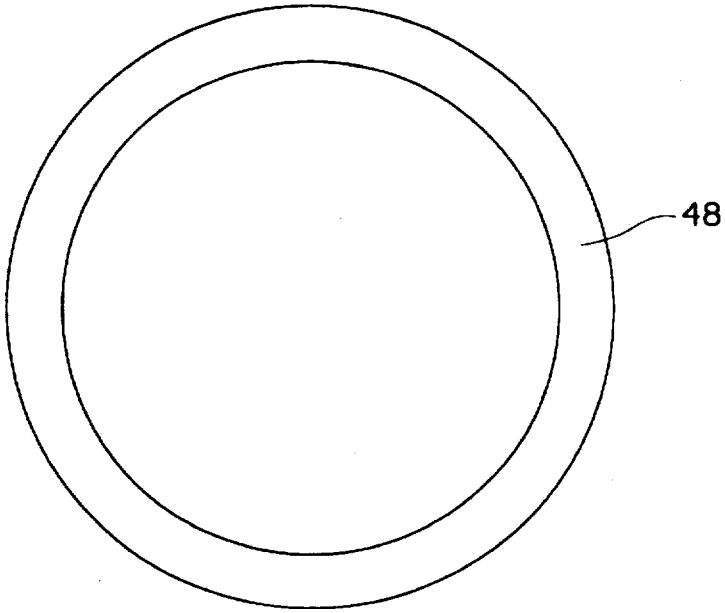
FIG. 6 is a side view of a wave washer, according to one preferred embodiment of this invention.
Figure 7:
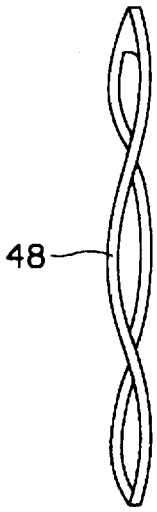
FIG. 7 is a front view of the wave washer as shown in FIG. 6.

In one preferred embodiment of this invention, spring element 48 comprises a wave washer, as shown in FIGS. 6 and 7. Such wave washer or any other suitable spring element 48 urges sleeve 30 away from the corresponding keeper 46 and/or keeper 47. The bias force of spring element 48 can be adjusted or balanced with a desirable degree of freedom for movement of pivot shaft 25 with respect to sleeve 30. Increasing the bias force of spring element 48 will further reduce the horizontal movement or longitudinal play of pivot shaft 25 with respect to sleeve 30, but will also increase the friction between keeper 46 and/or keeper 47 and sleeve 30 and/or thrust bearing 49. Keeper 46 and/or keeper 47 may be constructed as a conventional retaining ring, such as shown in FIG. 5, or may comprise any other suitable element that limits or prevents longitudinal movement of pivot shaft 25 with respect to sleeve 30.

As shown in FIG. 1, mounting apparatus 20 may also comprise stop element 39. As shown in FIGS. 1 and 3, stop element 39 is formed as a pin mounted within a corresponding bore of pivot shaft 25. As shown in FIGS. 1 and 9, sleeve 30 may have cutout 38. Stop element 39 is preferably mounted within cutout 38. As pivot shaft 25 rotates with respect to sleeve 30, stop element 39 preferably limits movement of pivot shaft 25 and thus arrow rest 15 between the set position, as shown in FIGS. 1 and 2, and the maximum forward position. At the set position and the maximum forward position, sleeve 30 interferes with further movement of stop element 39.

Many elements of this invention are preferably but not necessarily constructed of a lightweight metal, a polymeric material or any other suitable metal, plastic, graphite or composite material that is preferably lightweight, rigid and structurally sound.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. An apparatus for adjustably mounting an arrow rest within a shooting window positioned adjacent one side of an archery bow riser, the apparatus comprising:

a pivot shaft, a sleeve having a cylindrical outer surface and a cylindrical through bore, said pivot shaft rotatably mounted within said cylindrical through bore, said sleeve having opposing end surfaces, said pivot shaft having opposing shaft end portions each extending beyond a corresponding one of said opposing end surfaces;

mounting means for mounting and adjustably fixing a radial position of said sleeve with respect to a mounting surface of the archery bow riser, in a mounted position of said sleeve with respect to said mounting surface, one end surface of said opposing end surfaces positioned in a first area beyond said mounting surface at a first distance from said mounting surface, and another end surface of said opposing end surfaces positioned in a second area beyond said mounting surface at a second distance from said mounting surface, said first area being on the one side of the archery bow riser;

an end cap having a cap bore, said cylindrical outer surface of said sleeve rotatably mounted within said cap bore, said another end surface of said sleeve positioned within said cap bore; and a spring having one end foot and another end foot opposite said one end foot, said one end foot attached to one shaft end portion of said opposing shaft end portions, said one shaft end portion positioned within said cap bore, and said another end foot of said spring attached to said end cap.

2. An apparatus according to claim 1 wherein the arrow rest is releasably attached with respect to another shaft end portion of said opposing shaft end portions.

3. An apparatus according to claim 1 wherein said pivot shaft has a generally circular transverse cross section.

4. An apparatus according to claim 1 wherein said sleeve has a cutout, a stop element is fixed with respect to said pivot shaft, said stop element extends into said cutout, and said sleeve interferes with said stop element at a maximum forward position and at a set position of said pivot shaft with respect to said sleeve.

5. An apparatus according to claim 1 wherein said mounting means comprise a bracket, said bracket having a through hole and said cylindrical outer surface of said sleeve rotatably and longitudinally slidably mounted within said through hole.

6. An apparatus according to claim 1 further comprising securement means for locking said sleeve into a longitudinal position and a radial position with respect to said mounting surface.

7. An apparatus according to claim 1 wherein said spring is a coiled spring.

8. An apparatus according to claim 7 wherein said one shaft end portion of said pivot shaft has an opening, said coiled spring is positioned about said one pivot shaft end portion, and said one end foot of said coiled spring is mounted within said opening.

9. An apparatus according to claim 7 wherein said coiled spring is helical.

10. An apparatus according to claim 7 wherein said coiled spring is spiral.

11. An apparatus according to claim 1 further comprising adjustment means for fixing a radial position of said end cap with respect to said sleeve.

12. An apparatus according to claim 11 wherein said adjustment means comprise at least a portion of said cylindrical outer surface of said sleeve having an irregular surface.

13. An apparatus according to claim 11 wherein said adjustment means comprise at least a portion of said cylindrical outer surface of said sleeve having a plurality of grooves.

14. An apparatus according to claim 11 wherein said adjustment means comprise said end cap having an internally threaded bore exposed to said cap bore, a compressible member at least partially positioned within said internally threaded bore, and an externally threaded screw engaged within said internally threaded bore, and said externally threaded screw urging said compressible member against said sleeve when said radial position is fixed.

15. An apparatus according to claim 14 wherein in said fixed radial position said compressible member abuts said cylindrical outer surface of said sleeve and frictionally resists movement of said end cap with respect to said sleeve.

16. An apparatus according to claim 1 further comprising a keeper element attached to at least one of said one shaft end portion of said pivot shaft near said sleeve and an opposite shaft end portion of said pivot shaft near said sleeve, a spring element positioned between said sleeve and said keeper element.

17. An apparatus according to claim 16 further comprising a thrust bearing positioned adjacent one of said end surfaces of said sleeve.

18. An apparatus according to claim 16 wherein said spring element urges said sleeve away from said keeper element.

19. In an apparatus for adjustably mounting an arrow rest attached with respect to a pivot shaft which is rotatably mounted within a sleeve, wherein a longitudinal position and a radial position of the pivot shaft with respect to an archery bow riser is adjustable, a spring has an adjustable bias force acting upon the pivot shaft, the sleeve is adjustably fixed with respect to the archery bow riser, and an end cap is rotatably mounted about the sleeve, the improvement comprising:

the spring having one end portion and an opposite end portion, said one end portion fixed with respect to the pivot shaft, said opposite end portion fixed with respect to the end cap.

20. In an apparatus for adjustably mounting an arrow rest attached with respect to a pivot shaft which is rotatably mounted within a sleeve, wherein a longitudinal position and a radial position of the pivot shaft with respect to an archery bow riser is adjustable, a spring has an adjustable bias force acting upon the pivot shaft, and the sleeve is adjustably fixed with respect to the archery bow riser, the improvement comprising:

the pivot shaft having a first shaft end portion and a second shaft end portion, the sleeve having a first end surface and a second end surface, said first shaft end portion extending beyond said first end surface, said second shaft end portion extending beyond said second end surface, a keeper element attached to at least one of said first shaft end portion near said sleeve and said second shaft end portion near said sleeve, and a spring element positioned between said sleeve and said keeper element.

21. In an apparatus according to claim 20 further comprising a thrust bearing positioned adjacent one of said end surfaces of said sleeve.

22. In an apparatus for adjustably mounting an arrow rest attached with respect to a pivot shaft which is rotatably mounted within a sleeve, wherein a set position of the pivot shaft with respect to an archery bow riser is adjustable, a spring has an adjustable bias force acting upon the pivot shaft, and the sleeve is adjustably fixed with respect to the archery bow riser, the improvement comprising:

the pivot shaft having a first shaft end portion and a second shaft end portion, said first shaft end portion extending beyond an end surface of the sleeve, a keeper element attached to said first shaft end portion near said sleeve, and a thrust bearing positioned between said sleeve and said keeper element.

23. In an apparatus according to claim 22 further comprising a spring element positioned to urge said keeper element toward the sleeve.

* * * * *